US012426627B2

(12) United States Patent
Schneebaum et al.

(10) Patent No.: US 12,426,627 B2
(45) Date of Patent: Sep. 30, 2025

(54) ASHTRAY KIT

(71) Applicant: SnowTree Worldwide Inc., Plainview, NY (US)

(72) Inventors: David S. Schneebaum, Plainview, NY (US); Eli Max Schneebaum, Plainview, NY (US); Heeyoung Yoon, Little Neck, NY (US)

(73) Assignee: SNOWTREE WORLDWIDE INC., Plainview, NY (US)

( * ) Notice: Subject to any disclaimer, the term of this patent is extended or adjusted under 35 U.S.C. 154(b) by 263 days.

(21) Appl. No.: 18/103,579

(22) Filed: Jan. 31, 2023

(65) Prior Publication Data

US 2023/0240358 A1 Aug. 3, 2023

Related U.S. Application Data

(60) Provisional application No. 63/305,215, filed on Jan. 31, 2022.

(51) Int. Cl.
*A24F 19/10* (2006.01)

(52) U.S. Cl.
CPC ..... *A24F 19/10* (2013.01)

(58) Field of Classification Search
CPC ..... A24F 19/10
USPC ..... D27/103, 125, 128, 130, 133, 138, 7
See application file for complete search history.

(56) References Cited

U.S. PATENT DOCUMENTS

| | | | | | |
|---|---|---|---|---|---|
| 3,519,002 | A * | 7/1970 | Davis | A24F 19/0064 | 131/241 |
| 5,056,696 | A * | 10/1991 | Lahr | A45F 5/021 | 224/677 |
| 5,601,598 | A * | 2/1997 | Fisher | A61H 39/04 | 131/270 |
| 2014/0124632 | A1* | 5/2014 | Bouse | A24F 19/0092 | 248/205.1 |
| 2015/0232158 | A1* | 8/2015 | Bouse | F16M 13/022 | 248/205.2 |
| 2018/0116279 | A1* | 5/2018 | Donoho | A24F 19/0085 | |

* cited by examiner

*Primary Examiner* — Cynthia Szewczyk
(74) *Attorney, Agent, or Firm* — Hodgson Russ LLP

(57) ABSTRACT

There is disclosed an ashtray kit comprising at least one strap, at least one ashtray configured to couple to the strap, wherein the ashtray has at least one prong. There is also at least one lighter holder. In at least one embodiment the ashtray further comprises at least one additional container. In at least one embodiment, the prong is substantially conical in shape. In at least one embodiment the strap comprises a hook and loop fastener. In at least one embodiment the strap is made from a fabric material. In at least one embodiment the strap further comprises notches. In at least one embodiment, the strap further comprises at least one catch. In at least one embodiment the kit comprises at least one adapter.

20 Claims, 21 Drawing Sheets

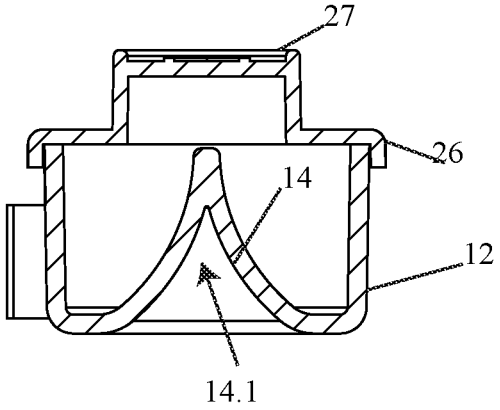
FIG. 9
FIG. 10
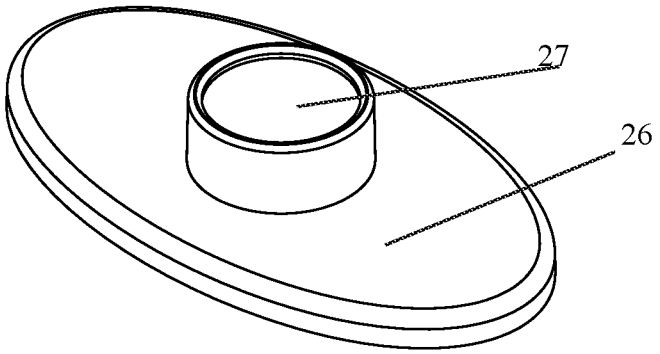
FIG. 11
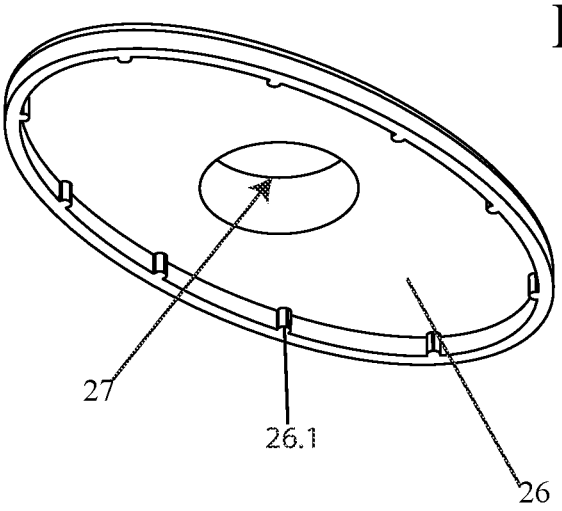

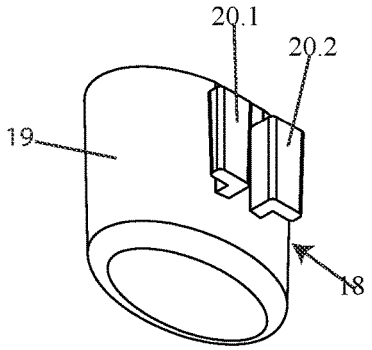
FIG. 12
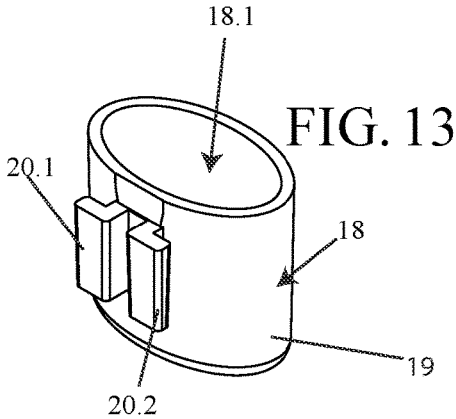
FIG. 13
FIG. 14
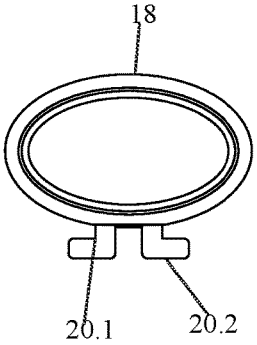
FIG. 15
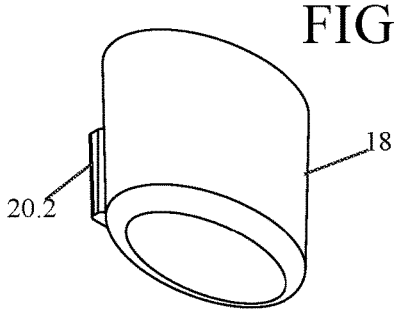

ASHTRAY KIT

CROSS REFERENCE TO RELATED APPLICATIONS

This application is a non-provisional application which claims priority to Provisional Application Ser. No. 63/305,215 filed on Jan. 31, 2022, the disclosure of which is hereby incorporated herein by reference in its entirety.

BACKGROUND

At least one embodiment of the invention relates to an ashtray kit. The ashtray kit may be adapted for use with a waterpipe or another associated holder. For example, there is an adaptable strap that can be used to couple the ashtray kit to the waterpipe or to the other associated holder.

SUMMARY

There is disclosed an ashtray kit comprising at least one strap, at least one ashtray configured to couple to the strap, wherein the ashtray has at least one prong. There is also at least one lighter holder. In at least one embodiment, the ashtray further comprises at least one additional container. In at least one embodiment, the prong is substantially conical in shape. In at least one embodiment, the strap comprises a hook and loop fastener. In at least one embodiment the strap is made from a fabric material. In at least one embodiment the strap further comprises notches. In at least one embodiment, the strap further comprises at least one catch. In at least one embodiment the kit comprises at least one adapter. In at least one embodiment the ashtray further comprises prongs configured to fit into the adapter. In at least one embodiment the prongs are substantially L-shaped prongs and wherein said adapter further comprises a slot configured to receive said L-shaped prongs.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 9 is a side cross-sectional view of the ashtray;

FIG. 10 is a top perspective view of the cover for the ashtray;

FIG. 11 is a bottom perspective view of the top for the ashtray;

FIG. 12 is a bottom back perspective view of the lighter holder;

FIG. 13 is a top back perspective view of the lighter holder;

FIG. 14 is a top view of the lighter holder;

FIG. 15 is a front bottom view of a lighter holder;

DETAILED DESCRIPTION

Figure 1:
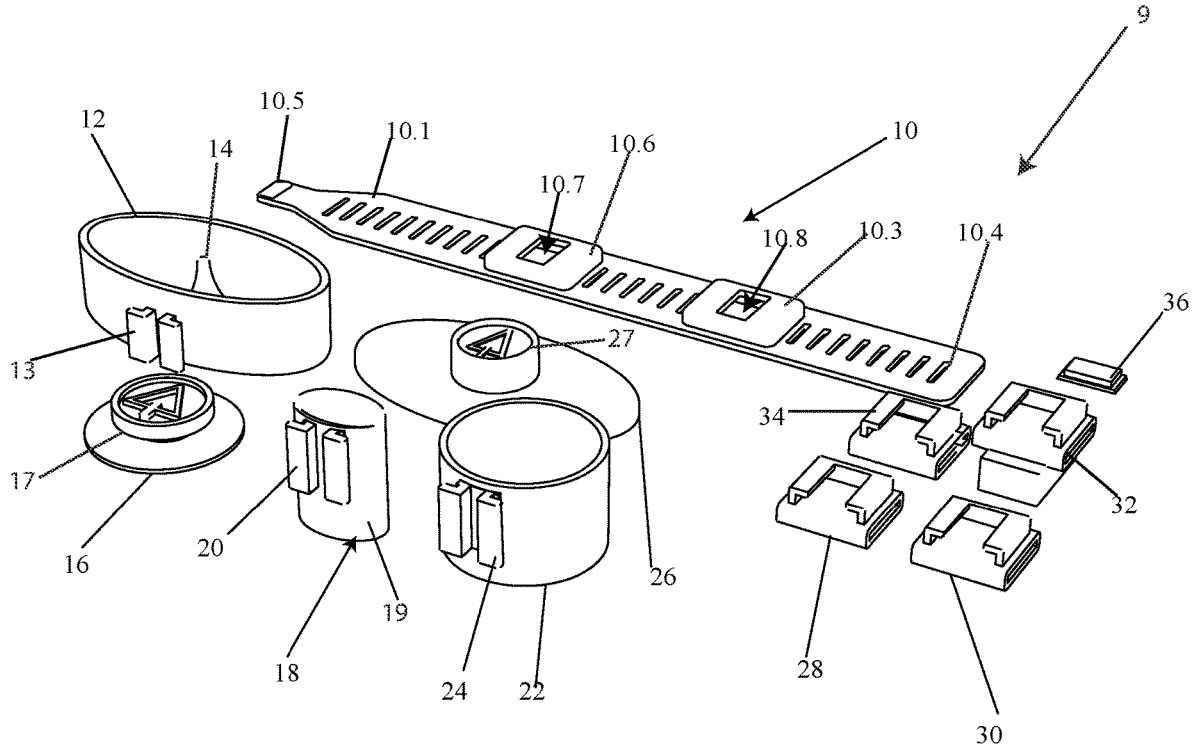
FIG. 1 is a top perspective view of an ashtray kit for use with a water pipe.
Figure 2:
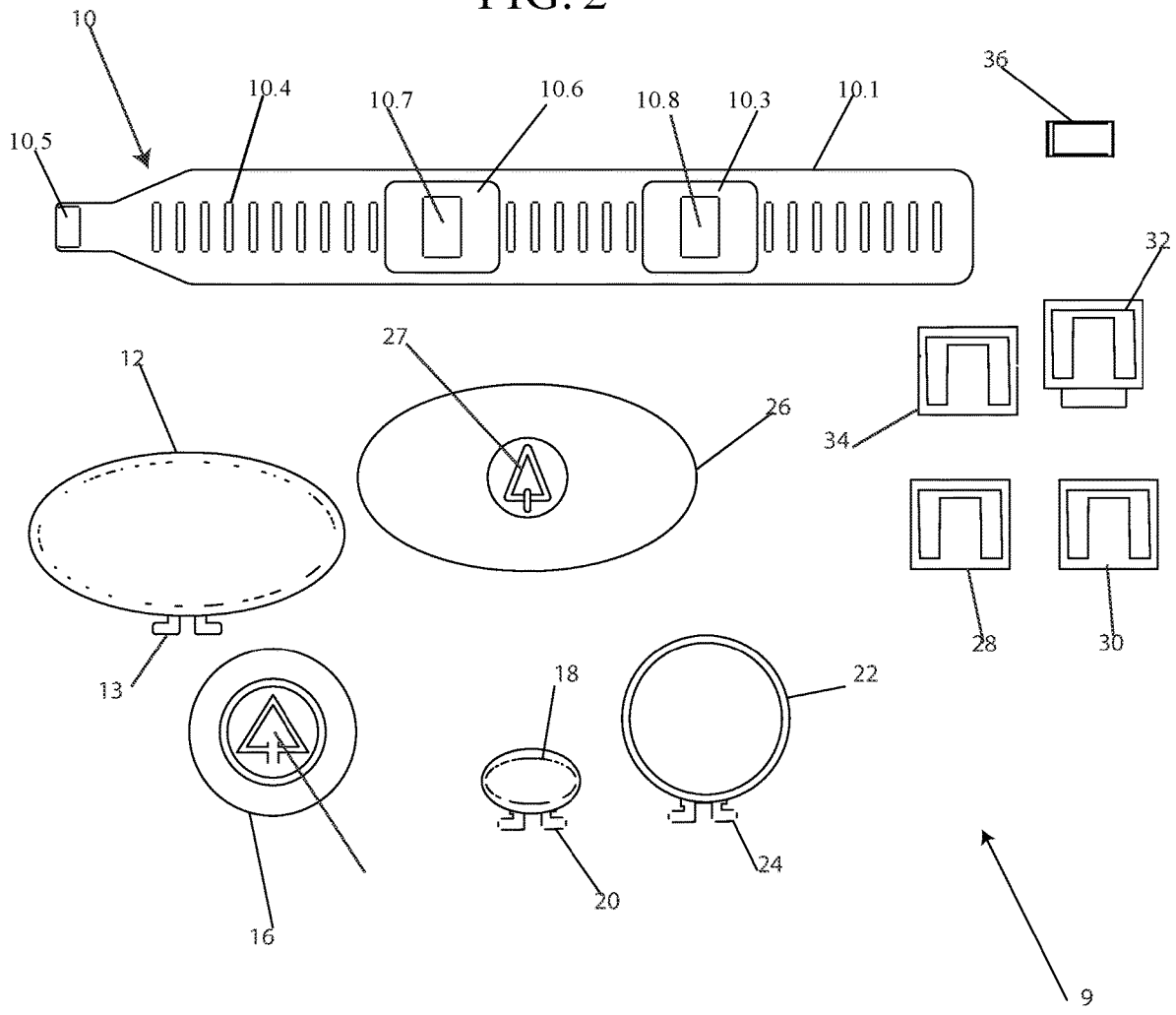
FIG. 2 is a top view of the kit shown in FIG. 1.

Referring to the drawings, FIG. 1 shows a perspective view and FIG. 2 shows a top or plan view of an ashtray kit 9 having a strap 10 which includes a strap body 10.1 having raised catches 10.3 and 10.6 each having respective holes 10.2 and 10.7. The strap is adjustable having a plurality of notches 10.4 which are configured to receive a lock 10.5. In the kit is a first container or ashtray 12 having a prong or protrusion 14 which is configured to puncture or clean out a bowl of a water pipe. The ashtray 12 has a plurality of prongs 13 which are configured to snap into any one of raised catches 10.3 or 10.6 or to slide into slots of associated adapters or brackets 28, 30, 34 and 32. First container or ashtray 12 is substantially oval in shape.

Notches 10.4 provide for a variable length adjustable strap which has lock 10.5 being insertable into any one of the suitable notches thereby forming a variable adjustable loop which can be fit over a substantially cylindrical object such as a water pipe or other suitable object. In addition, included with the kit is a top or lid 26 having a protrusion or handle 27. Handle 27 is configured to be hollow so that it can receive prong 14 when the lid 26 is put on the first container 12. Lid 26 fits over first container or ashtray 12 to thereby cover it. In addition, there is also a second container or lighter holder 18, and prongs 20 which are substantially L shaped prongs coupled to body section 19. Second container or lighter holder 18 is substantially oval in cross section but can be of any suitable shape. There is also another container 22 which can also be used, this container is substantially cylindrical in shape and has L-shaped prongs such as prongs 24 as well.

Another top 16 can be used with container 22 to cover container 22. This top 16 also has a handle 17 which allows for gripping of this top.

Brackets or adapters are provided which include adapter or bracket 28, bracket 30, bracket 34 and bracket 32 as well as a plug 36 for plugging into hole or openings 10.7 and 10.8.

Figure 3:
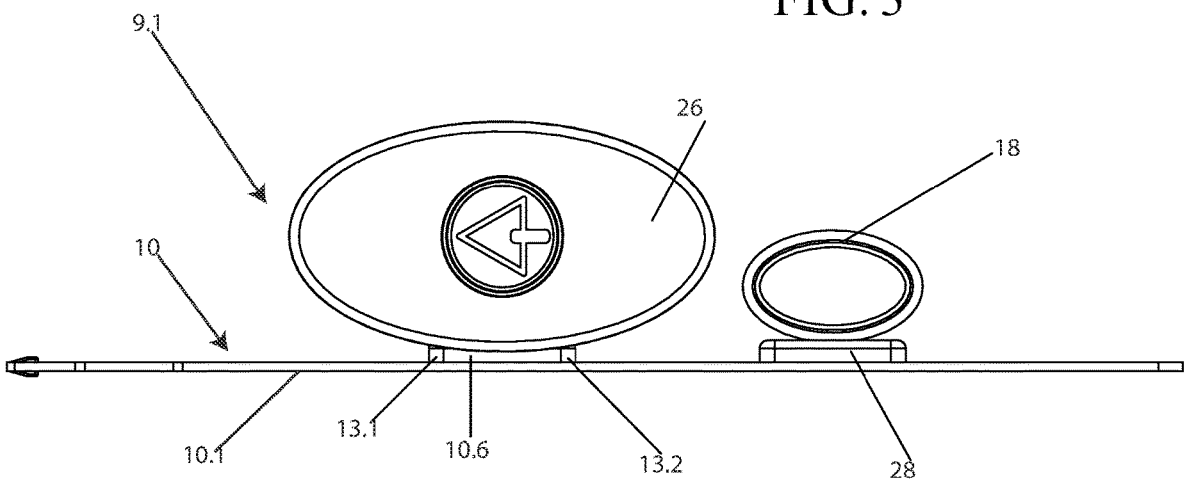
FIG. 3 is a top view of a portion of the kit assembled.

FIG. 3 shows a top view of an assembled form with the strap 10, the lid 26, the strap body 10.1 shown as well as the prongs 13.1 and 13.2 extending through the strap body 10.1 especially through the catch 10.6. There is also the second container or lighter holder 18 as well as the adapter or bracket 28 shown attached to the strap body 10.1. This embodiment is shown as embodiment 9.1. Thus, the device operates such that when the first container 12 is connected to the strap, it is positioned adjacent to the second container 18.

Figure 4:
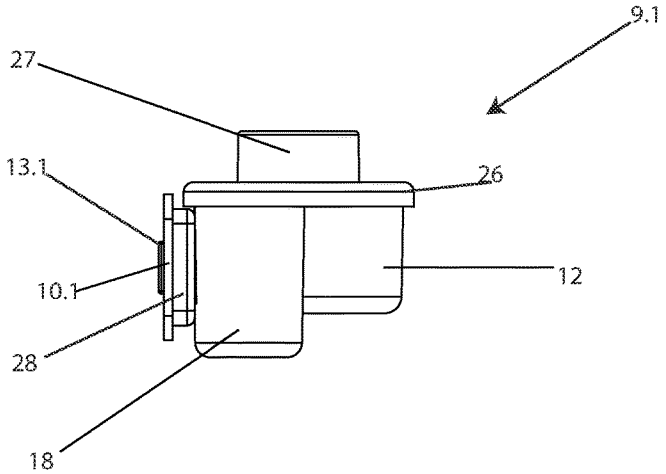
FIG. 4 is a side view of the kit assembled.

FIG. 4 is a side view of the embodiment shown in FIG. 3. For example, there is shown handle 27, lid 26, as well as first container or ashtray 12 coupled to strap 10.1 with prongs 13.1 extending through a catch. There is also shown adapter or bracket 28 for coupling to another or second container or lighter holder 18.

Figure 5:
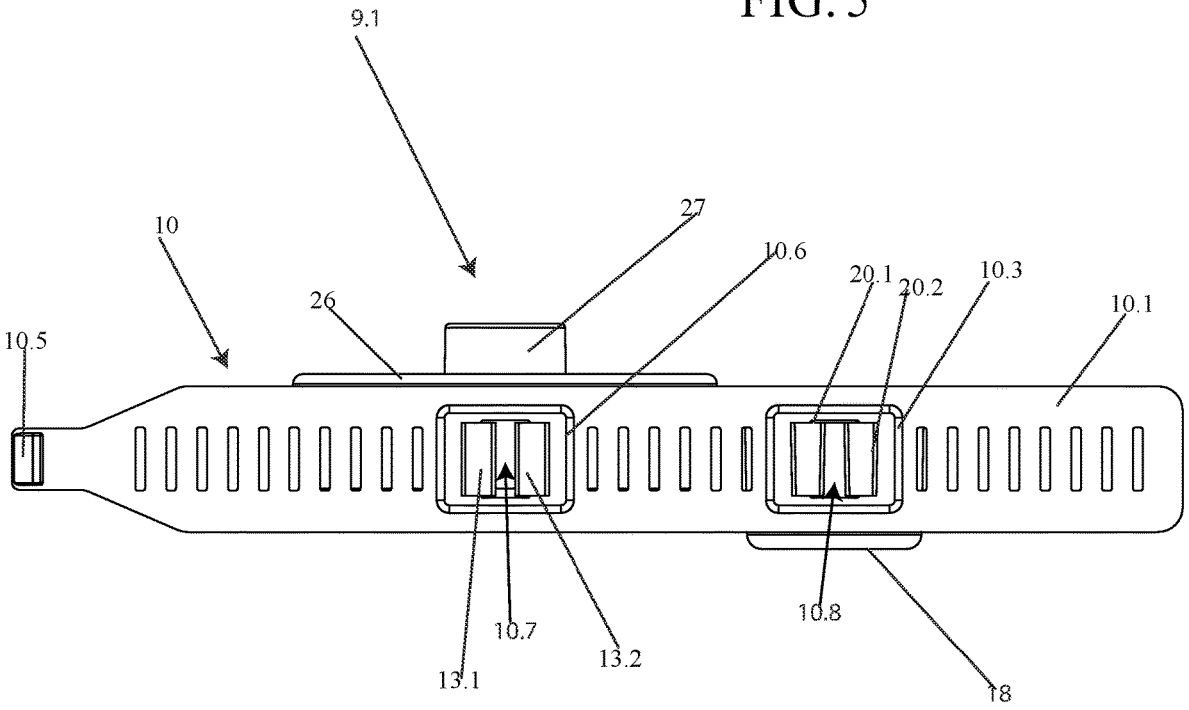
FIG. 5 is a back view of the kit assembled.

FIG. 5 is a back view of the strap 10 showing strap body 10.1 as well as catches 10.3 and 10.6 for receiving the ashtray prongs 13.1 and 13.2 in catch 10.6 and prongs 20.1 and 20.2 through catch 10.3. These prongs 13.1 and 13.2 snap through the associated catch 10.6 through the associated hole 10.7. In addition, prongs 20.1 and 20.2 are configured to snap through catch 10.3 through hole 10.8 of this catch. Therefore, this strap is adapted to receive the different catches of the different ashtrays/containers shown in the kit.

Figure 6:
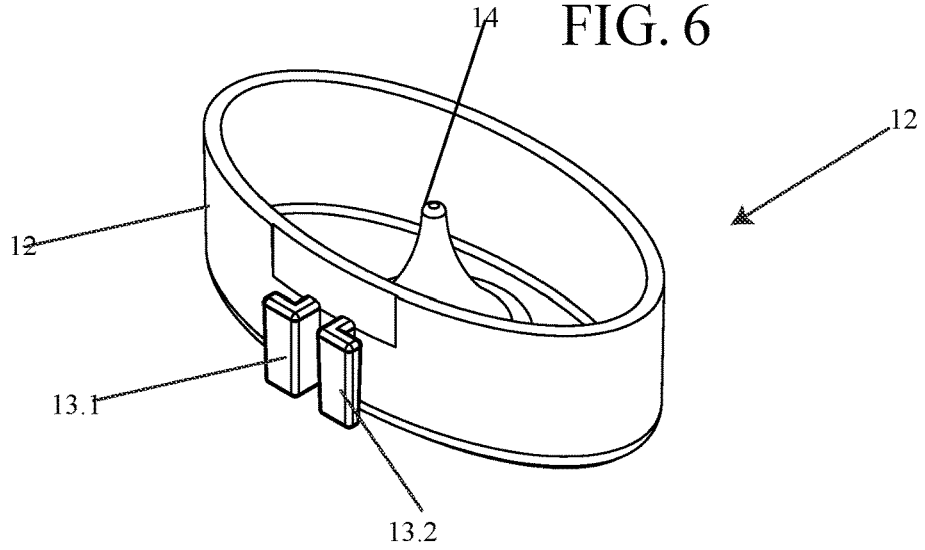
FIG. 6 is a top perspective view of the ashtray in an open state.

FIG. 6 shows a top-back perspective view of the ashtray which shows an ashtray container 12 having a conical protrusion 14 which is configured to poke out the bowl of a water pipe so that the bowl of the water pipe can be cleaned after use. In addition, there are a plurality of L-shaped prongs which are configured to snap through the associated catches of a strap.

Figure 7:
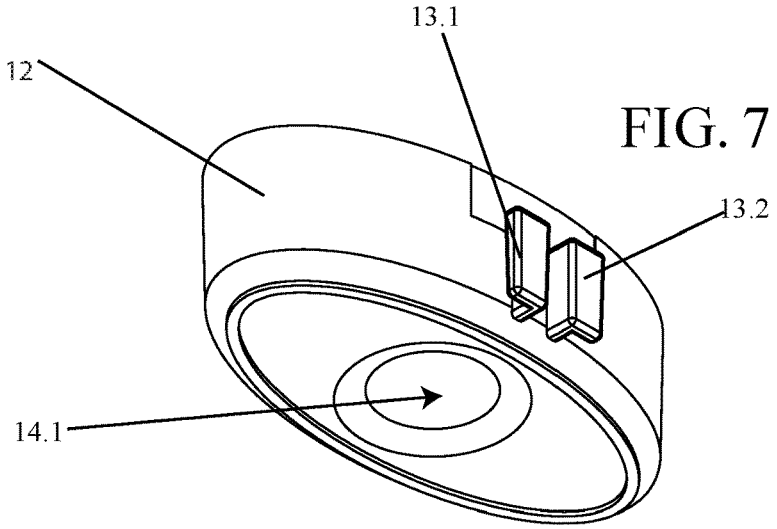
FIG. 7 is a bottom-back perspective view of the ashtray as shown in FIG. 6.
Figure 8:
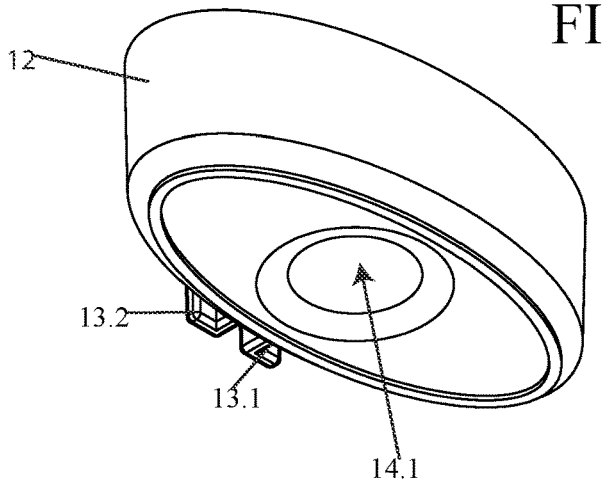
FIG. 8 is a bottom front perspective view of the ashtray shown in FIG. 6.

FIG. 7 is a bottom back view of a first container or ashtray 12 which has shown a recess portion 14.1 which is configured to form a mirror image of the conical protrusion 14 thereby forming a recess. These features are also shown in FIG. 8 which is a bottom front view of this ashtray.

FIG. 9 is a side cross-sectional view of the ashtray showing the conical protrusion 14 sloped up inside of the first container or ashtray 12. The lid 26 is shown with the handle 27 shown coupled to the lid 26. There is a recess 14.1 shown formed from the conical protrusion 14 as well.

FIG. 10 is a top perspective view of the lid 26 having handle 27. FIG. 11 is a bottom perspective view showing handle 27 forming a recess inside of the lid 26. The inside of the lid having a plurality of protrusions or fingers 26.1 for securing to the first container or ashtray 12.

FIG. 12 shows a back, bottom perspective view of the lighter holder which shows an oval shaped body 19 along with L-shaped prongs 20.1 and 20.1, these parts are also shown in FIGS. 13, 14, and 15 and wherein FIG. 13 also shows the oval shaped opening 18.1 in body 19.

Figure 16:
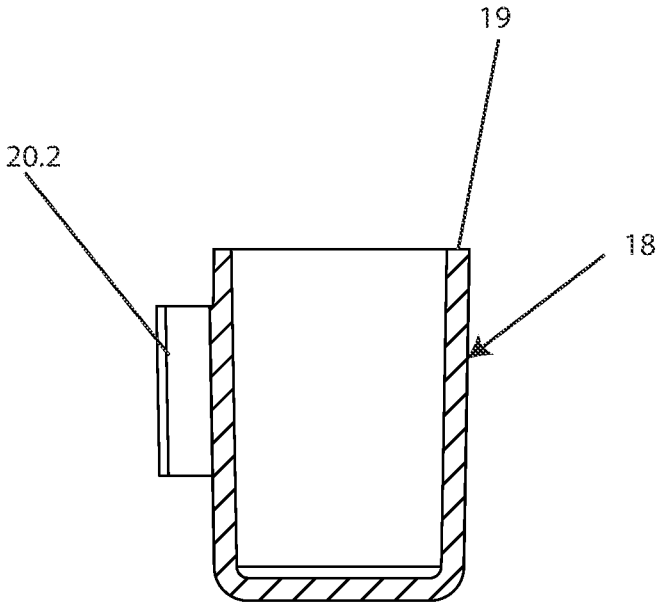
FIG. 16 is a side cross-sectional view of the lighter holder.

FIG. 16 is a side cross-sectional view of the second container or lighter holder 18. Coupled to the body 19 of the second container or lighter holder 18 are L-shaped prongs 20.2 extending back therefrom.

Figure 17:
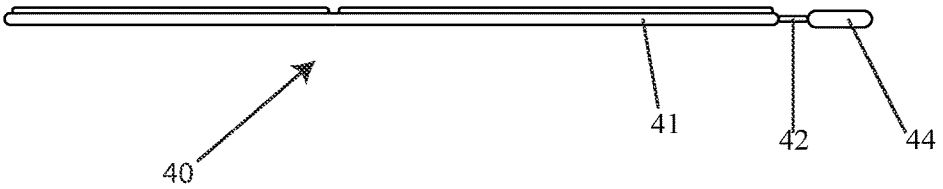
FIG. 17 is a side view of a hook and loop fastener strap.

FIG. 17 is a side view of a strap such as a flexible hook and loop fastener strap 40. This strap 40 includes a body portion 41, a link 42 and a strap loop 44. Body portion 41 is made from a fabric or wave material so that its is flexible. Link 42 and loop 44 are made from any suitable material such as a fabric, plastic or metal.

Figure 18:
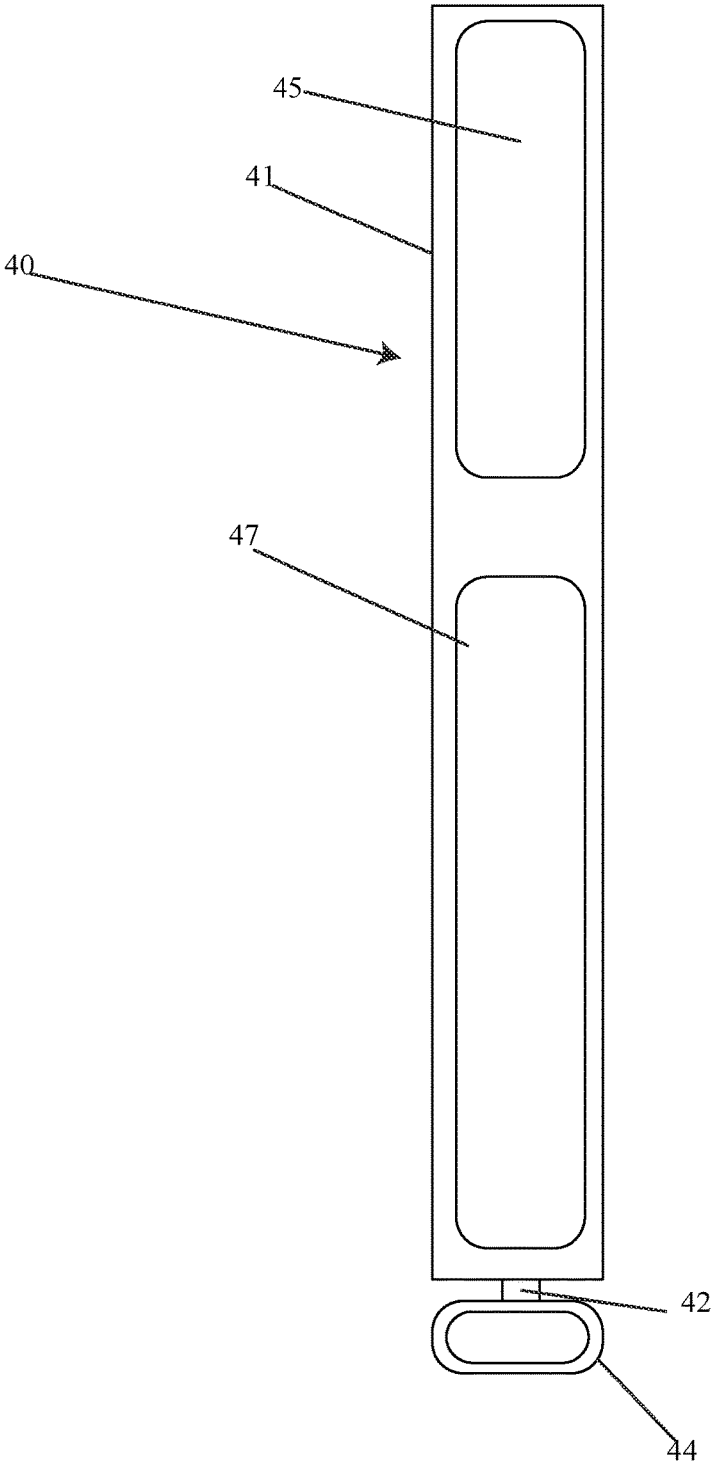
FIG. 18 is a top plan view of a hook and loop fastener strap.
Figure 18A:
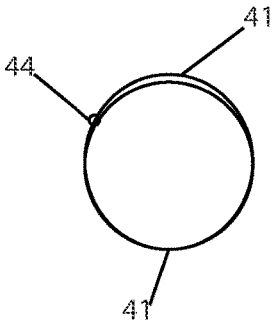
FIG. 18A is a side view of the strap connected together.

FIG. 18 is a top or plan view of the strap 40 which includes a strap body 41 as well as a first part 45 of the hook and loop fastener and a complimentary part or portion 47 of a hook and loop fastener. Link 42 is shown coupled to the body section as well as loop 44. Link 42 allows for the loop 44 to be rotationally coupled to the link and/or the strap body 41 allowing for flexibility in adjustment. The end of the opposite portion of the strap body 41 can then slide through the loop 44 and then flip back again to mate with the complementary portion of the strap, thereby allowing for the mating of the two different parts of the hook and loop fastener to meet thereby forming a closed loop. For example, FIG. 18A shows the strap body 41 looped back through loop 44 so that a portion of the body such as that containing first part 45 is looped over on top of a second portion 47 thereby causing a mating of the two parts or portions 45 and 47 together.

Figure 19:
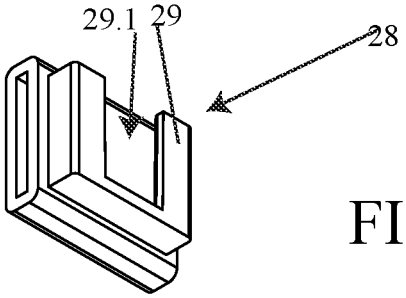
FIG. 19 is a bottom front view of an adapter for the strap of FIG. 18.
Figure 20:
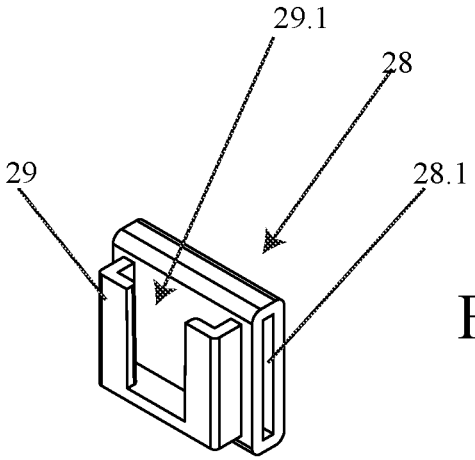
FIG. 20 is a top front view of the adapter of FIG. 19.

FIG. 19 shows a bottom perspective view of bracket 28 which has a slot 29.1 formed from prongs 29. Slot 29.1 is configured to receive prongs such as prongs 13, 20 and 24. FIG. 20 shows the top front perspective view which shows a view having prongs 29 configured to receive prongs 13, 20 and 24 therein to slot 29.1. Another slot 28.1 is configured to receive a strap which would be configured to slide through slot 28.1. That strap could be strap 40 or any other suitable strap.

Figure 21:
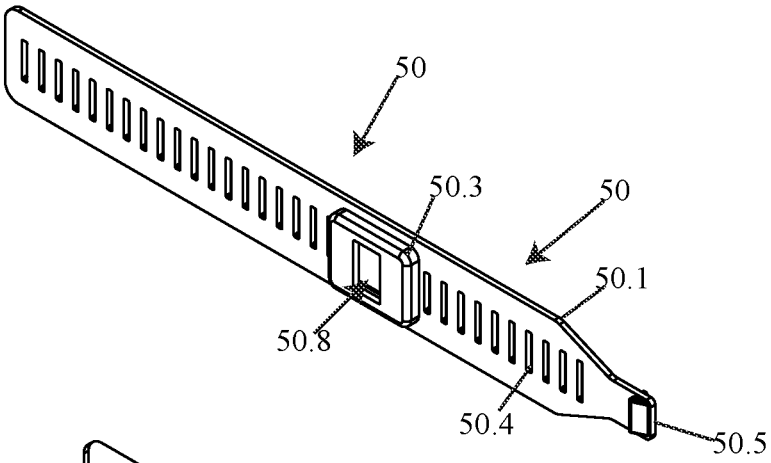
FIG. 21 is a top front view of another strap.
Figure 22:
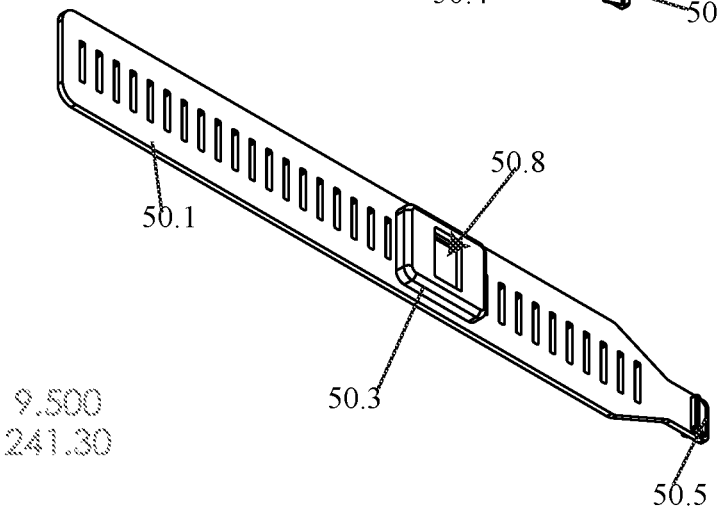
FIG. 22 is a bottom front view of the strap.

FIG. 21 is a top front right side perspective view of another strap 50. This strap 50 includes a strap body 50.1, a catch 50.3, having an opening 50.8 as well as notches 50.4 This strap 50 is similar to strap 10 but it includes one less catch. This strap also has a lock 50.5 which is configured to slide through notch 50.4 and lock the lock 50.5 therein. These features are also shown in FIG. 22 which is a bottom left front perspective view.

Figure 23:
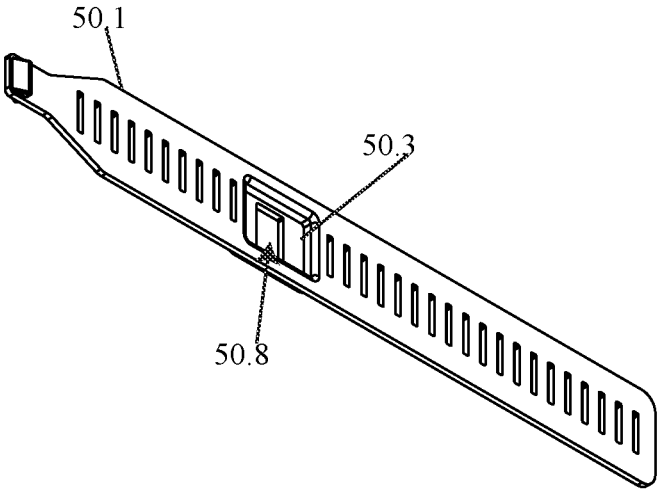
FIG. 23 is a back bottom view of the strap.

FIG. 23 is the back bottom left side perspective view of the strap 50 having strap body 50.1 a recessed catch 50.3 as well as a hole 50.8 shown therein.

Figure 24:
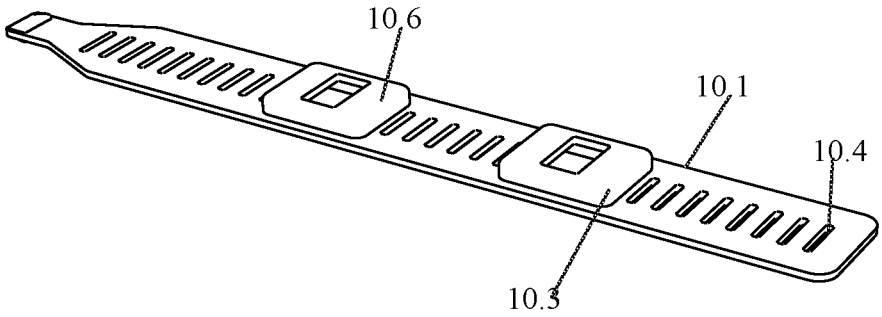
FIG. 24 is a top view of the strap shown in FIG. 1.
Figure 25:
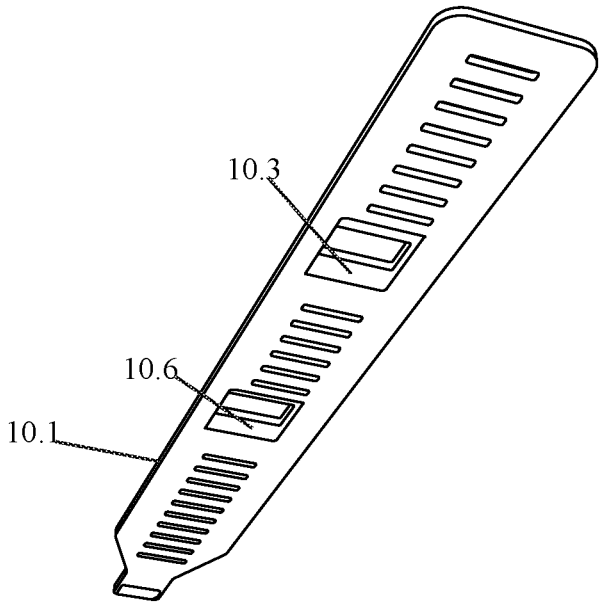
FIG. 25 is a bottom perspective view of the strap of FIG. 24.

FIG. 24 shows a bottom front left perspective view of the strap 10 having catches 10.6 and 10.3 as well as strap body 10.1. Notches 10.4 are shown formed in strap body 10.1. FIG. 25 is a bottom perspective view of the strap 10.1 having catches 10.3 and 10.6 shown recessed into strap body 10.1.

Figure 26:
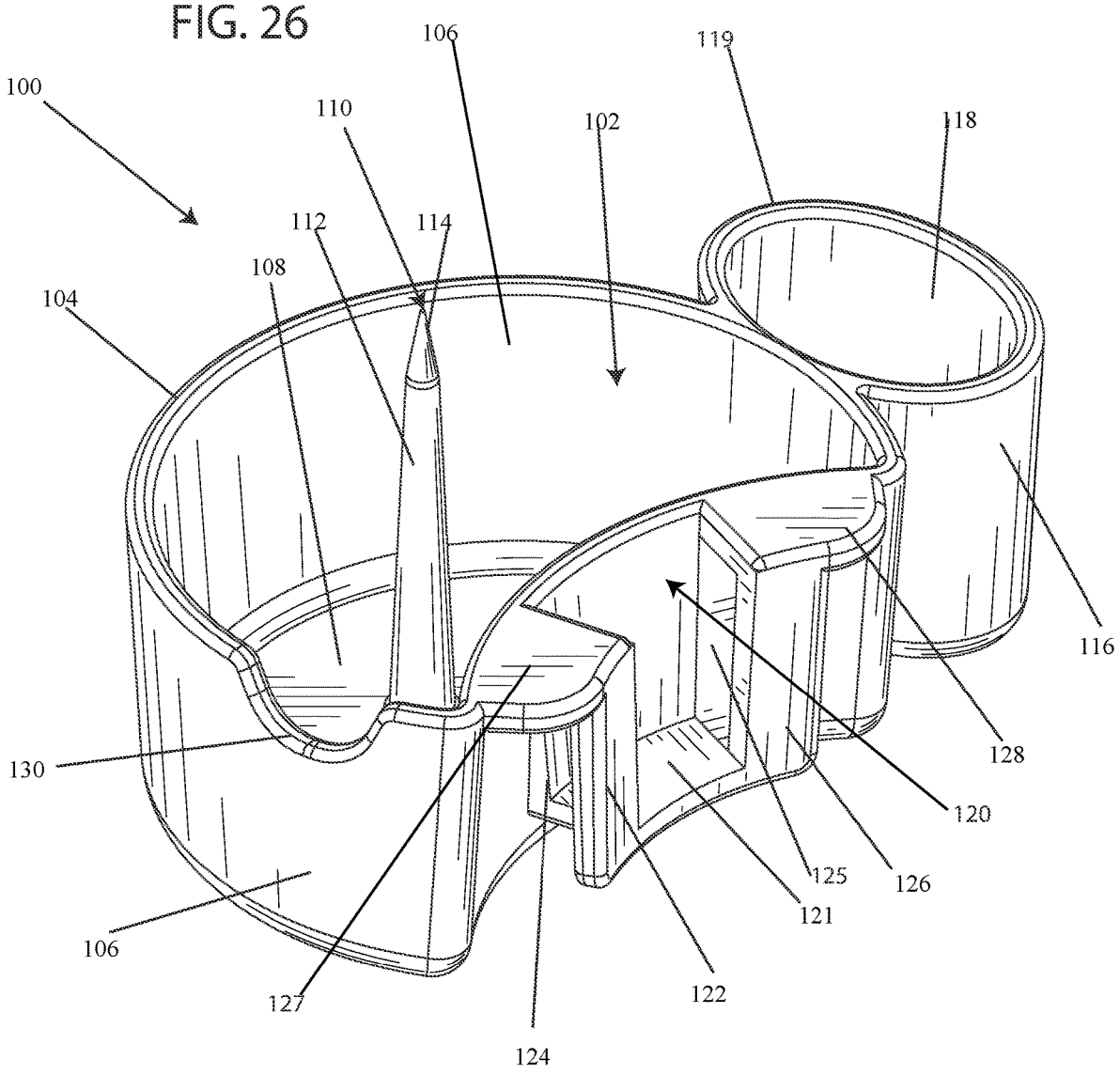
FIG. 26 is a top perspective view of another embodiment.

FIG. 26 is a top perspective view of another embodiment. This embodiment 100 is a view which shows a first container 102 which has side walls 106 and a rim 104. The shape of the container 102 is substantially kidney shaped and with side walls 106 extending from rim 104 to base or bottom section 108. There is also a prong or spike 110 which has a base 112 and a tip 114. Tip 114 is configured to be a spike type tip to drive embedded material out of an opposite container housing compacted material. The container 102 also has an outer surface and an indented rim portion 130 of rim 104. There is also a side container 116 which has side walls and a rim 119. Side container 116 has walls 118 and is substantially oval in cross-section. Side container 116 can be used for any suitable purpose, but in at least one embodiment is configured to house at least one lighter.

There is a connector 120 which includes holes or openings 124 and 125 which are bound by surfaces or walls 122 and 126 respectively. Connector 120 also has a base or bottom spacer element 121. These holes or openings 124 and 125 are configured for receiving a strap extending therethrough. There are also upper walls 127 and 128 opposite base or bottom spacer element 121.

Figure 27:
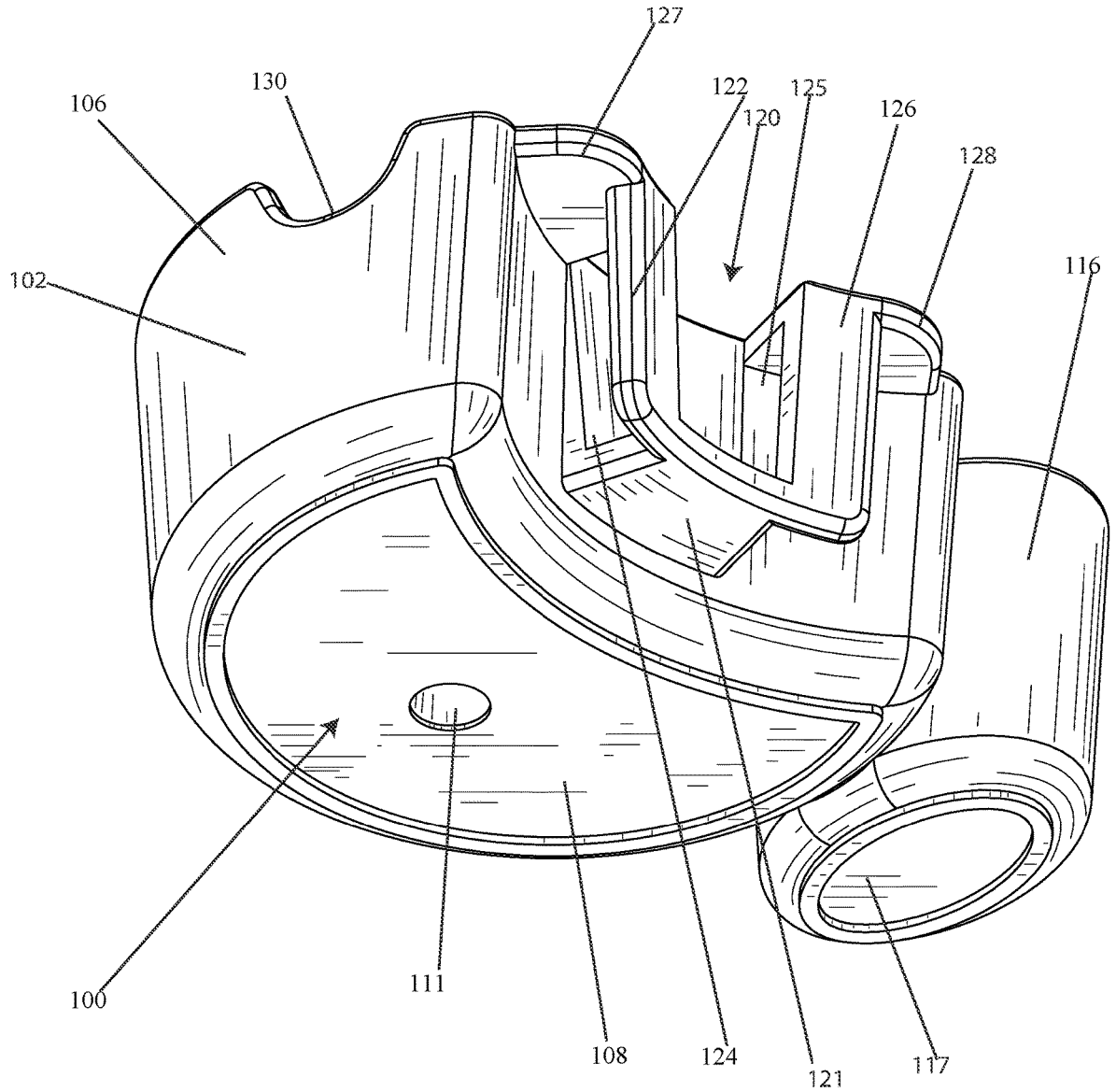
FIG. 27 is a bottom perspective view of the embodiment of FIG. 26.

FIG. 27 is a bottom perspective view of the embodiment of FIG. 26. This view shows side wall 106 of bowl or container 102 with indent 130 formed therein. There is also a bottom surface 108 as well as hole or recess 111 which is a recess which forms spike 110. Openings 124 and 125 are shown in connector 120. There is a first spacer 121 shown as well as front surfaces or walls 122 and 126 formed adjacent to holes or openings 124 and 125. Upper walls 127 and 128 are also shown and form a spacing extending substantially perpendicular to the extension of openings 124 and 125. Side container 116 has a bottom surface 117 and is shown connected to first container 102.

Figure 28:
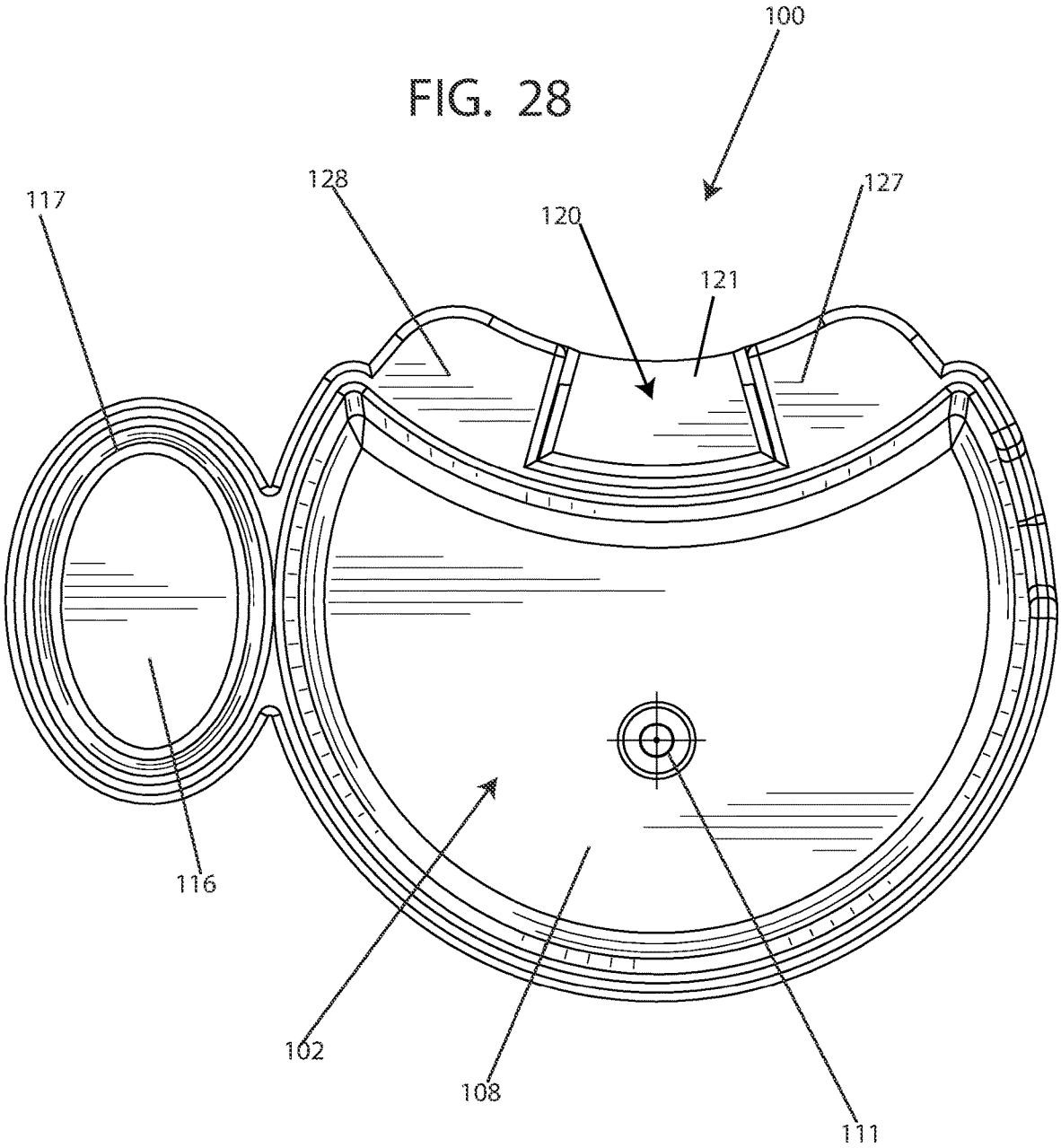
FIG. 28 is a bottom view of the embodiment of FIG. 26.

FIG. 28 is a bottom view of the embodiment of FIG. 26. This view shows embodiment 100 having a side container 116 which is substantially oval shaped coupled to a container 102 which is substantially kidney shaped. A recess 111 is formed in the bottom surface 108 of container 102. There is also shown connector 120 having a surface 121 as well as upper walls 127 and 128 which are used to space out openings (not shown here).

Figure 29:
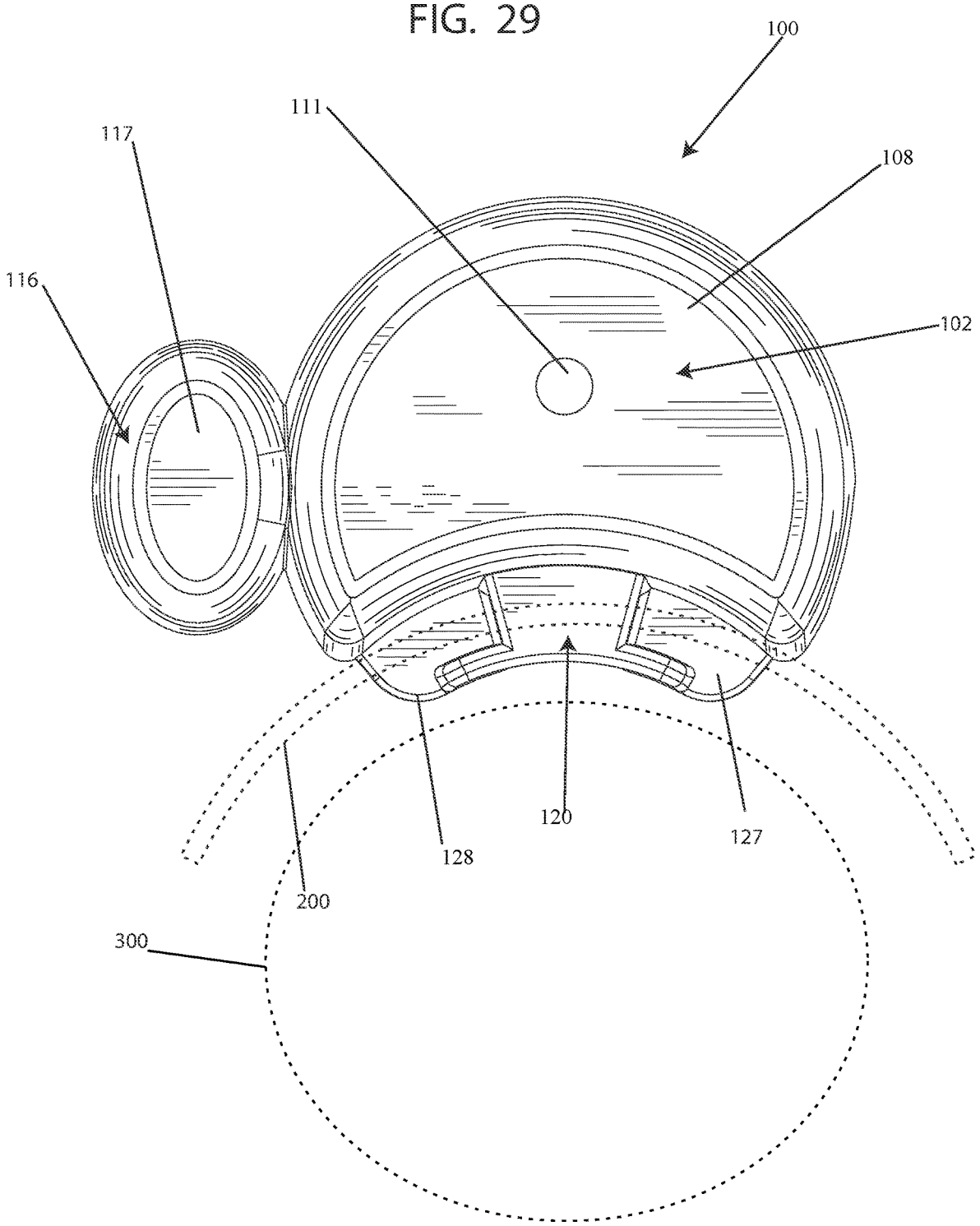
FIG. 29 is a bottom view of the embodiment of FIG. 26.

FIG. 29 is a bottom view of the embodiment of FIG. 26 which shows connector having a bottom surface or spacer 121 as well as upper walls 127 and 128. Connector is configured to house a strap 200 shown by a dashed dotted line which slides through openings 124 and 125. Strap 200 is configured to wrap around container 300 which can be in the form of any suitable container but in this embodiment is a substantially cylindrical container. This view also shows main kidney shaped container 102 having a bottom surface and recess 111, as well as side container 116 having bottom surface 117. In this embodiment it is shown that first container 102 is connected directly to second container 116.

Figure 30:
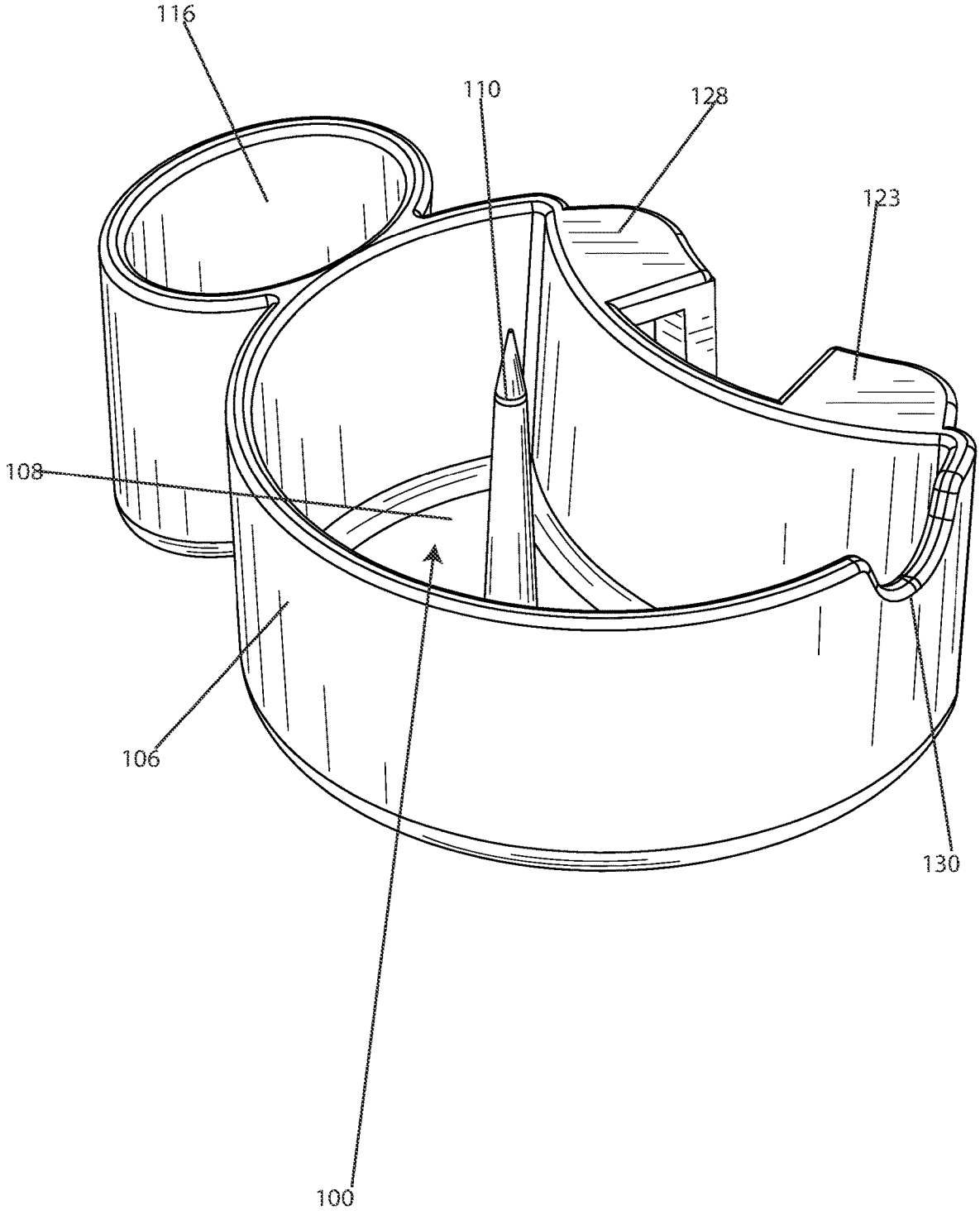
FIG. 30 is a top perspective view of the embodiment of FIG. 26.

FIG. 30 is a top perspective view of the embodiment 100 of FIG. 26. In this view there is shown a main container 102 having side walls 106, a side container 116 as well as a connector 120 having upper walls 127 and 128. There is also shown indent 130 which can be used to receive a cylindrically shaped object such as a cigarette. Prong or spike 110 is shown extending up from main container 102 bottom 108.

Figure 31:
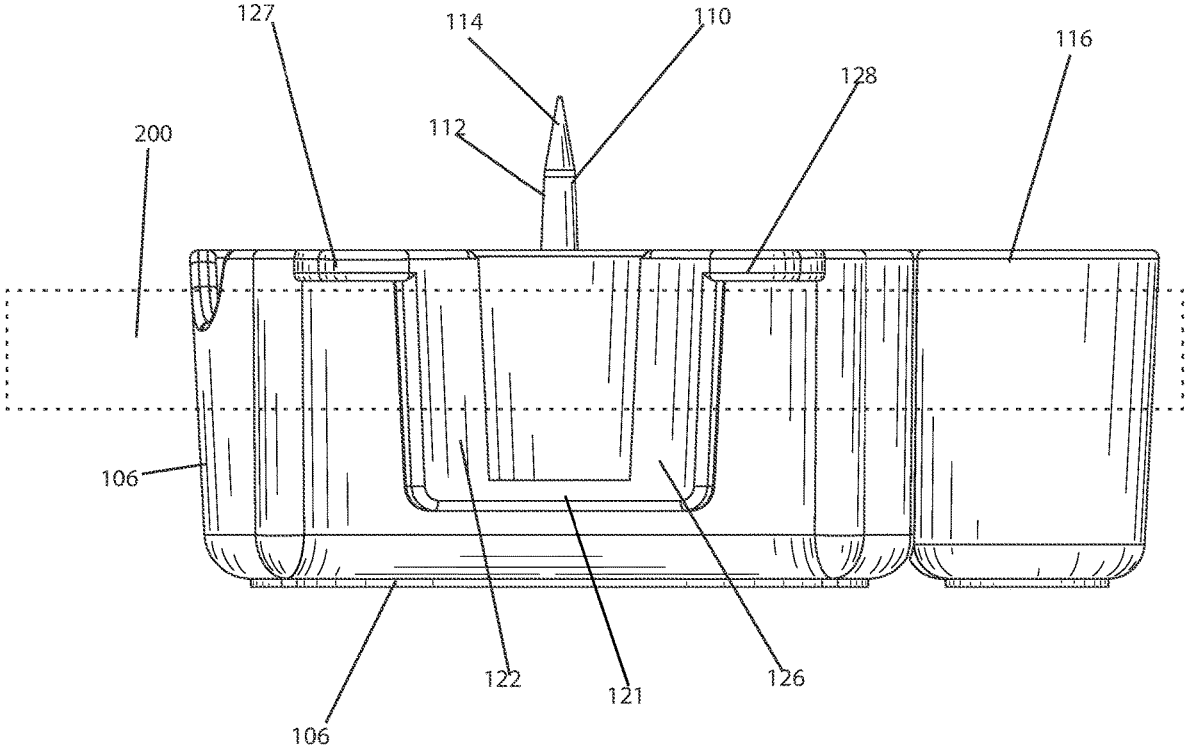
FIG. 31 is a side view of the embodiment of FIG. 26.

FIG. 31 is a side view of the embodiment of FIG. 26. This side view of embodiment 100 shows connector 120 having upper walls 127 and 128. As well as side container 116. There is shown strap 200 extending through connector 120 wherein this strap 200 extends through openings 124 and 125 between body side wall 106 and front walls 122 and 126. Prong or spike 110 extend up from container 102 and shows the conical shape of spike portion or tip 114 up from base or body section 112.

Figure 32:
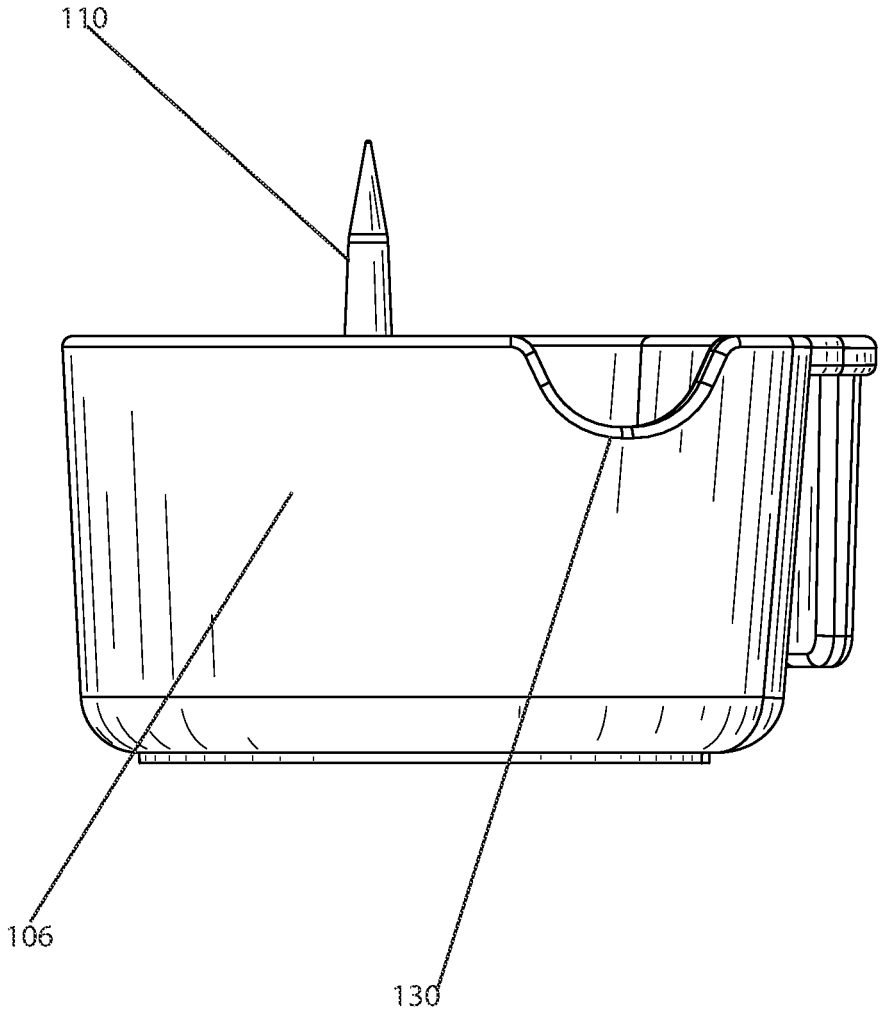
FIG. 32 is an opposite side view of the embodiment of FIG. 26.

FIG. 32 is an opposite side view of the embodiment of FIG. 26 which shows embodiment 100 having spike 110 extending up from container 102 and above side walls 106 of container 102. Indented rim 130 is shown as well.

Figure 33:
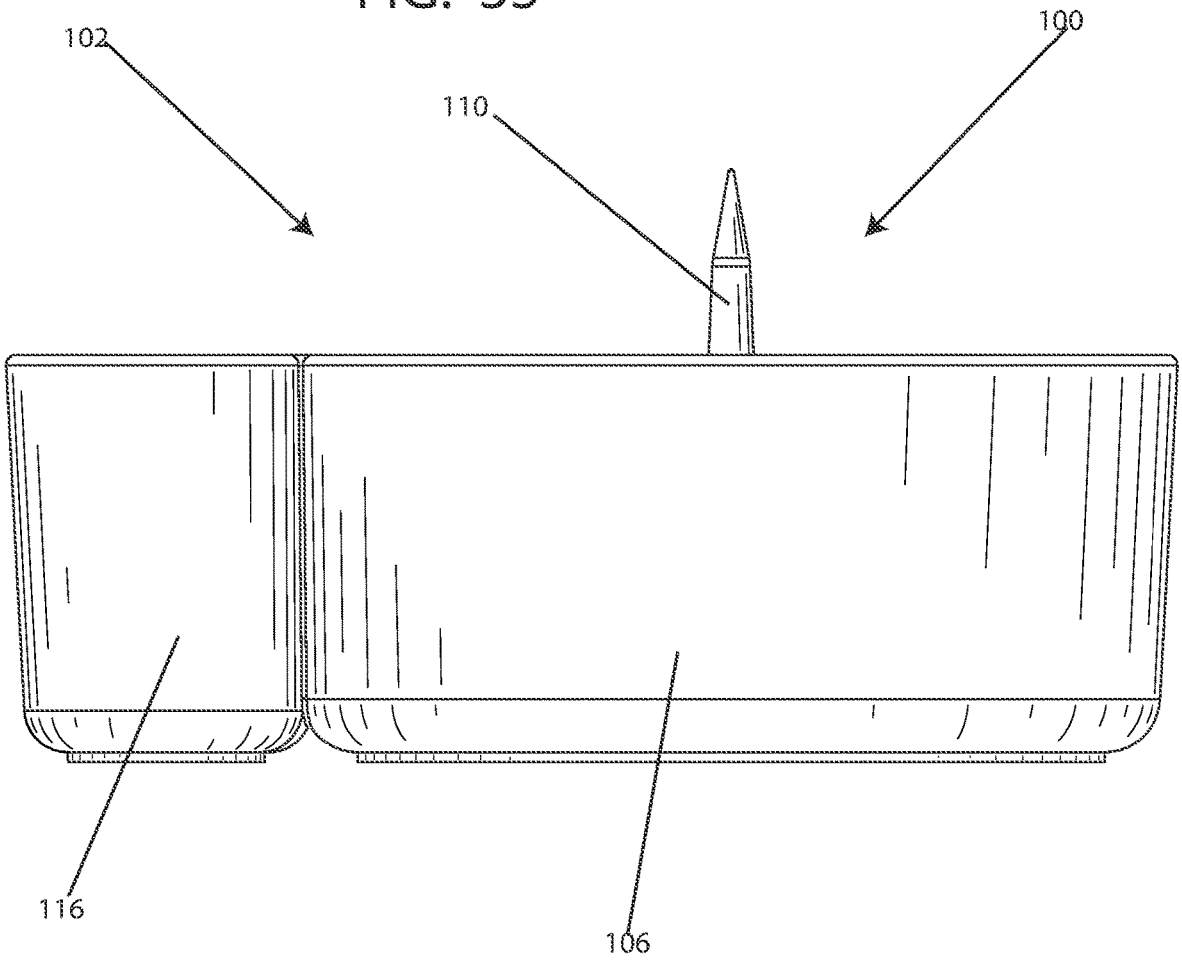
FIG. 33 is a side view of the embodiment of FIG. 26.

FIG. 33 is a side view of the embodiment 100 showing spike 110 as well as side container 116 and main container 102 having side walls 106.

Figure 34:
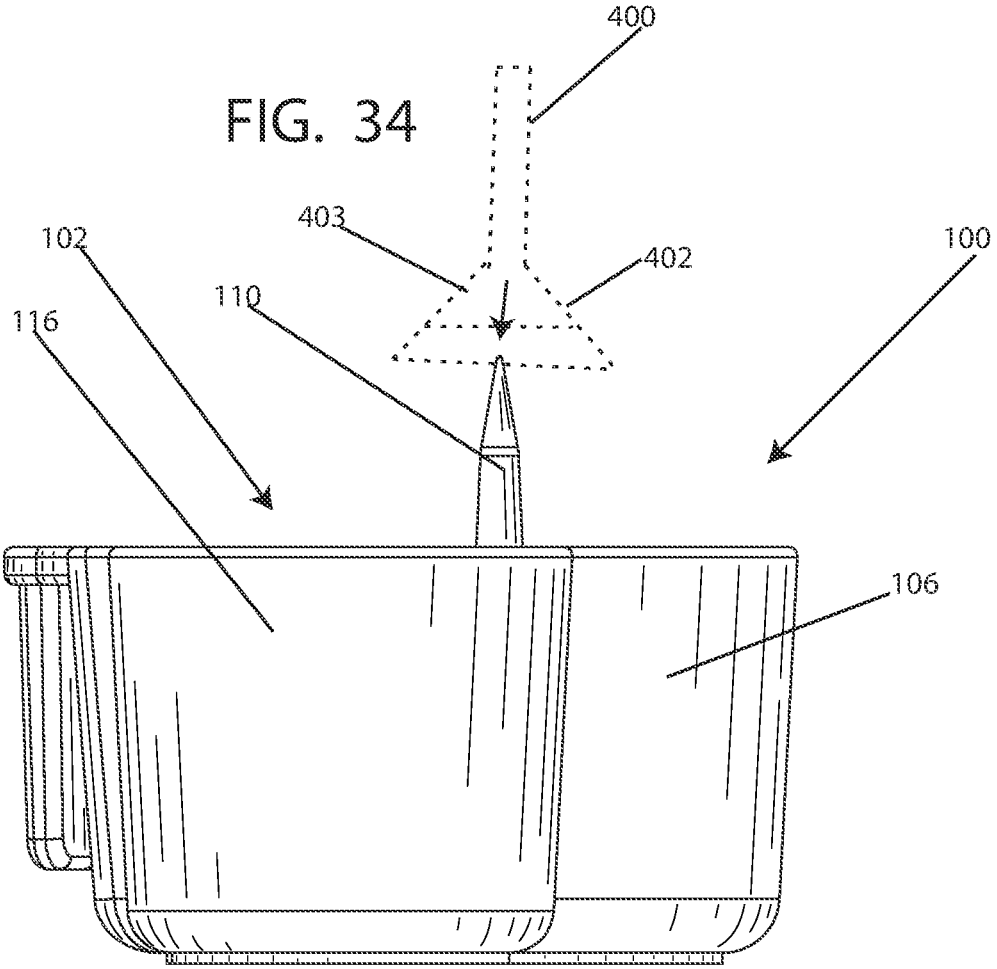
FIG. 34 is another side view.

FIG. 34 is another side view which shows side container 116 as well as main container 102 having side walls 106. Spike 110 is shown extending up above side walls 106. Spike 110 is for cleaning out container objects such as container object 400 having a bowl section 402 filled with cooked or burned packed material such as smokeable material from a water pipe. Thus, this burned material could then drop into main container 102 while the bowl section 402 is cleaned out by spike by lowering container 400 onto spike 110.

Accordingly, while at least one embodiment of the present invention have been shown and described, it is to be understood that many changes and modifications may be made thereunto without departing from the spirit and scope of the invention as defined in the appended claims.

What is claimed is:

1. An ashtray kit comprising:

at least one strap;

at least one first container configured to couple to the strap, said at least one first container having at least one connector, said at least one connector configured to connect to said at least one strap, wherein said at least one first container includes a bottom section and side walls extending a first height from the bottom section, the bottom section and the sidewalls forming an ashtray;

at least one second container coupled to said at least one first container; and a spike extending a second height from the bottom section within the ashtray;

wherein the second height is greater than the first height, such that the spike extends from the bottom section above the side walls and out of the ashtray;

wherein the spike and at least one first container are integrally formed.

2. The ashtray kit as in claim 1, further comprising at least one third container coupled to said at least one first container.

3. The ashtray kit as in claim 1, wherein said strap comprises a hook and loop fastener.

4. The ashtray kit as in claim 3, wherein said strap is made from a fabric material.

5. The ashtray kit as in claim 1, wherein said strap further comprises notches.

6. The ashtray kit a in claim 5, wherein said strap further comprises at least one catch.

7. The ashtray kit as in claim 1 further comprising at least one adapter.

8. The ashtray kit as in claim 7, wherein said at least one first container comprises prongs configured to fit into said at least one adapter.

9. The ashtray kit as in claim 8, wherein said prongs are substantially L-shaped prongs and wherein said adapter further comprises a slot configured to receive said L-shaped prongs.

10. The ashtray kit as in claim 1, wherein said first container is substantially oval shaped and said second container is substantially oval shaped, wherein said second container is configured as a lighter holder and adapted to receive a lighter.

11. The ashtray kit as in claim 10, further comprising at least one adapter for connecting said at least first one container to said strap.

12. The ashtray kit as in claim 10, wherein said first container is substantially kidney shaped in cross section.

13. The ashtray kit as in claim 1, wherein said connector comprises at least one hole for receiving said strap.

14. The ashtray kit as in claim 1, wherein said second container is smaller than said first container.

15. The ashtray kit as in claim 1, wherein said connector comprises a bottom spacer wall and at least two upper walls.

16. The ashtray kit as in claim 15, wherein said connector comprises at least two front walls wherein said connector comprises at least two openings for receiving said strap, wherein said at least two openings are bound by said front walls, said bottom spacer and said at least two upper walls.

17. The ashtray kit as in claim 1, wherein the spike comprises a base extending from the bottom section and a conical tip coupled to the base.

18. The ashtray kit as claimed in claim 17, wherein the base extends out of the ashtray beyond the side walls.

19. The ashtray kit as in claim 1, wherein the at least one strap forms a variable adjustable loop, and the spike extends parallel to an axis of the variable adjustable loop.

20. An ashtray kit comprising:

at least one strap;

at least one first container configured to couple to the strap, said at least one first container having at least one connector, said at least one connector configured to connect to said at least one strap, wherein said at least one first container includes a bottom section and side walls extending a first height from the bottom section, the bottom section and the sidewalls forming an ashtray;

at least one second container coupled to said at least one first container;

a spike extending a second height from the bottom section within the ashtray;

at least one adapter;

wherein the second height is greater than the first height, such that the spike extends from the bottom section above the side walls and out of the ashtray;

wherein the spike and at least one first container are integrally formed of a same material;

wherein the spike comprises a base extending from the bottom section and a conical tip coupled to the base;

wherein the second container is smaller than said first container;

wherein said first container is substantially oval shaped and said second container is substantially oval shaped, wherein said second container is configured as a lighter holder and adapted to receive a lighter;

wherein said at least one first container comprises prongs configured to fit into said at least one adapter;

wherein said prongs are substantially L-shaped prongs and wherein said adapter further comprises a slot configured to receive said L-shaped prongs.

* * * * *